United States Patent [19]

Yoshida et al.

[11] 3,986,875

[45] Oct. 19, 1976

[54] POLYMERIC AMMONIUM MORDANTS FOR DYE TRANSFER

[75] Inventors: Takashi Yoshida; Takushi Miyazako, both of Minami-ashigara, Japan

[73] Assignee: Fuji Photo Film Co., Ltd., Minami-ashigara, Japan

[22] Filed: Aug. 20, 1974

[21] Appl. No.: 499,108

[30] Foreign Application Priority Data

Aug. 20, 1973 Japan ..... 48-93701

[52] U.S. Cl. ..... 96/29 D; 96/3; 96/77; 96/119 R; 428/411

[51] Int. Cl.[2] ..... G03C 5/54; G03C 7/00; G03C 1/40; B44D 1/09

[58] Field of Search ..... 96/3, 29 D, 77, 114, 96/119 R, 84 A; 117/161 UN, 161 UA; 260/32.6 N, 89.7 N; 428/411; 101/464

[56] References Cited

UNITED STATES PATENTS

| | | | |
|---|---|---|---|
| 3,271,148 | 9/1966 | Whitmore | 96/3 |
| 3,709,690 | 1/1973 | Cohen et al. | 96/114 |

OTHER PUBLICATIONS

"Aliphatic Ionenes," *Journal of Polymer Science*, Part B Polymer Letters, vol. 6 pp. 159–161, 1968.

"Ionene Polymers–," Noguchi et al, *Journal of Polymer Science*, Part B Polymer Letters, vol. 7, pp. 383–394 (1969).

*Primary Examiner*—David Klein
*Assistant Examiner*—Richard L. Schilling
*Attorney, Agent, or Firm*—Sughrue, Rothwell, Mion, Zinn and Macpeak

[57] ABSTRACT

An image-receiving element for use in a color diffusion transfer process which comprises a support having thereon an image-receiving layer containing a mordanting polymer having therein a repeating structural unit represented by the following General Formula (I);

(I)

wherein each of $R_1$, $R_2$, $R_3$ and $R_4$ is an alkyl group, a hydroxyalkyl group or an aralkyl group, and each of $R_1$ and $R_3$ and $R_2$ and $R_4$ can combine to form an alkylene group; A is an alkylene group, an arylene group or a group of the formula in which *m* and *n* each represents 0 or an integer of at least 1, with at least one of *m* and *n* being an integer of at least 1; and $X^-$ and $Y^-$ each represents a monovalent anion, and a method for forming a color image in the color diffusion transfer process comprising spreading an alkaline processing solution between an exposed silver halide photosensitive element and the image-receiving element above described.

28 Claims, No Drawings

POLYMERIC AMMONIUM MORDANTS FOR DYE TRANSFER

BACKGROUND OF THE INVENTION

1. Field of the Invention

This invention relates to a photographic element and process, and, more specifically, to a color diffusion transfer element and process.

2. Description of the Prior Art

In the color diffusion transfer process, a photographic layer containing a silver halide photographic emulsion is exposed to form a latent image therein and is developed with a processing liquid to simultaneously form an image-like distribution of a color image-forming substance. At least a part of the color image-forming substance is transferred to an image-receiving layer to form a colored positive image.

Examples of color diffusion transfer processes are the process disclosed in U.S. Pat. No. 2,983,606 in which a color developing agent (i.e., a dye having the ability to develop silver halide and being capable of developing the exposed silver halide emulsion) is a dye image-forming substance, and the methods disclosed in U.S. Pat. Nos. 2,647,049 and 2,774,668 wherein a latent image is developed using a color developer to release a dye image-forming substance. The image-receiving element used in these methods is generally composed of a non-transparent or transparent support having thereon an image-receiving layer containing a polymer mordant which is water-permeable or alkali solution-permeable. Known polymer mordants include, for example, poly-4-vinyl pyridine disclosed in U.S. Pat. No. 3,148,061 or vinyl-type quaternary salt polymers disclosed in British Pat. No. 1,261,925.

SUMMARY OF THE INVENTION

An object of this invention to provide an image-receiving material for the color diffusion transfer process having an image-receiving layer containing a polymer mordant of a specific structure described hereinafter.

Another object of this invention is to provide a color diffusion transfer process using this specific image-receiving material.

According to this invention, a color diffusion transfer process is first provided, which comprises using as an image-receiving layer a layer containing a polymer mordant having a structural unit represented by the following general formula (I);

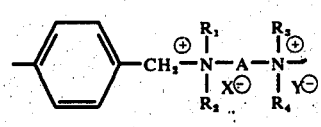

(I)

wherein each of $R_1$, $R_2$, $R_3$ and $R_4$ is an alkyl group, a hydroxyalkyl group or an aralkyl group; $R_1$ and $R_3$ and/or $R_2$ and $R_4$ can each combine to form an alkylene chain; A is an alkylene group, an arylene group or a group of the formula

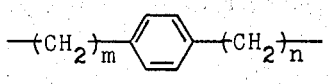

in which $m$ and $n$ each represents O or an integer of at least 1, and at least one of $m$ and $n$ is an integer of at least 1; and $X^{\ominus}$ and $Y^{\ominus}$ each represents a monovalent anion.

According to another aspect of this invention, an image-receiving element for use in the above color diffusion transfer process is provided, the element comprising a support having thereon a layer containing a polymer mordant containing therein the structural unit represented by the above general formula (I).

DETAILED DESCRIPTION OF THE INVENTION

The image-receiving layer used in this invention is especially preferred in a color diffusion transfer process using a dye developer. The improvement in accordance with this invention is especially outstanding when an anthraquinonic or azo dye developer, for example, is used.

A dye developer is a compound which contains a dye color developing portion or moiety and a silver halide developing group within the same molecule. Also, a dye developer can be defined as a dye which is a developer for silver halide. The term "silver halide developing group" designates a group capable of developing (reducing) silver halide which has been exposed. An especially useful dye developer is one wherein the silver halide developing group contains a benzenoid developing group. A preferred benzenoid developing group in such a compound is a hydroquinonyl group. Typical examples of dye developers are described in U.S. Pat. No 2,983,606. Other examples of useful dye developers are described in Japanese Pat. No. 252,111.

In the color diffusion transfer process using a dye developer, a silver halide latent image in a photographic element is developed in the presence of the dye developer, whereby the dye developer in the exposed area is oxidized and substantially fixed. At least part of this fixation is considered to be at least partially dependent upon changes in the solubility characteristics of the dye developer during oxidation, in particular, changes in the solubility of the dye developer in alkaline solutions. Since in the unexposed area and partially exposed area of the emulsion the dye developer remains unreacted and can be diffused, an image-like distribution of the unoxidized dye developer is provided in the liquid processing composition as a function of the extent of exposure at every point of the silver halide emulsion. At least a part of this image-like distribution of the unoxidized dye developer is transferred by imbibition to an image-receiving layer superimposed thereon. This transfer substantially does not involve the oxidized dye developer. The image-receiving element receives a depth-wise diffusion, from the developed emulsion, of the unoxidized dye developer without appreciably disturbing the image-wise distribution thereof to provide a positive color image of the developed image.

The present invention will be described in greater detail hereinbelow.

The image-receiving material used in the color diffusion transfer process in accordance with the present invention basically comprises a support having thereon an image-receiving layer capable of mordanting a dye. Preferably, the image-receiving material comprises a support having thereon, in this order, a layer of a neutralizing acidic polymer, a layer for regulating the rate of neutralization, and an image-receiving layer capable of mordanting a dye.

The support can, for example, be baryta paper, paper on which a resin such as polyethylene is laminated, a sheet of an organic acid ester of cellulose such as cellulose diacetate, cellulose triacetate or cellulose acetate butyrate, a sheet of an inorganic acid ester of cellulose such as cellulose nitrate, a sheet of a polyvinyl ester such as polyvinyl acetate or of polyethylene terephthalate, a sheet of polyvinyl acetal, or a sheet of a polyolefin such as polystyrene, polypropylene or polyethylene.

Preferably, the material used for the neutralizing acidic polymer layer is a film-forming acidic polymer containing at least one of a carboxyl group, sulfo group or group capable of being converted to a carboxyl group by hydrolysis. Any such acidic polymer can be used. The acidic polymer used in this invention has a molecular weight of preferably about 10,000 to about 100,000. Examples of such acidic polymers include a monobutyl ester of a 1:1 molar ratio copolymer of maleic anhydride and ethylene, a monobutyl ester of a 1:1 molar ratio copolymer of maleic anhydride and methylvinyl ether, a monoethyl ester, monopropyl ester, monopentyl ester or monohexyl ester of a 1:1 molar ratio copolymer of maleic anhydride and ethylene, a monoethyl ester, monopropyl ester, monopentyl ester or monohexyl ester of a 1:1 molar ratio copolymer of maleic anhydride and methylvinyl ether, polyacrylic acid, polymethacrylic acid, copolymers of acrylic acid and methacrylic acid in various ratios, and copolymers of acrylic acid or methacrylic acid with other vinyl monomers in various ratios, such as copolymers containing at least 30 mol%, preferably 50 to 90 mol%, of acrylic acid or methacrylic acid with acrylic acid esters, methacrylic acid esters or vinyl ethers. Such an acid polymer is coated on a support in the form of a solution in an alcohol such as methanol, ethanol, propanol or butanol, a ketone such as acetone, methyl ethyl ketone, diethyl ketone or cyclohexanone, an ester such as methyl acetate, ethyl acetate, isopropyl acetate or butyl acetate, or a mixture of these solvents.

Since the thickness of the neutralizing acidic polymer layer varies depending on the composition and amount of the processing agent to be used, and the material of the acidic layer, the thickness cannot be set forth unequivocally. Generally, however, a suitable thickness is about 5 to 30 microns.

The neutralizing acidic layer is disposed beneath the image-receiving layer. The acidic substance serves to neutralize the alkali in the liquid processing composition contained in the image-receiving layer. Accordingly, the diffusibility of the dye developer which has diffused from the photographic element can be reduced or destroyed, and the dye developer can be mordanted in the image-receiving layer with good efficiency.

A spacer layer can further be provided between the image-receiving layer and the neutralizing acidic layer in order to control the release of the acidic substance.

The polymer used for such a spacer layer can be, for example, a polyvinyl alcohol polymer, a polymer of a partially acetylated product of polyvinyl alcohol, or a polymer such as gelatin as disclosed in U.S. Pat. No. 3,362,819, or a polyvinyl amide graft copolymer as disclosed in U.S. Pat. No. 3,575,701. A homopolymer, copolymer or graft copolymer of a monoacrylic acid ester of a polyhydric alcohol and/or a monomethacrylic acid ester of a polyhydric alcohol, which are all alkali solution-permeable and water-permeable, can also be used.

The polyhydric alcohol is not limited in use as long as the final polymer is alkali solution-permeable and waterpermeable. Polyhydric alcohols which provide advantageous results in the present invention are compounds containing at least two aliphatic hydroxyl groups, preferably compounds containing 2 to 5 aliphatic hydroxyl groups and 2 to 12 carbon atoms. Examples of suitable polyhydric alcohols are diols such as polyethylene glycol, polypropylene oxide, polybutylene oxide, polycyclohexene oxide, polystyrene oxide, polyoxetane, polytetrahydrofuran, cyclohexane diol, xylylene diol or di($\beta$-hydroxyethoxy) benzene, and polyols such as glycerin, diglycerin, trimethylolpropane, triethylolpropane or pentaerythritol. Specific examples of the monoacrylic acid esters and monomethacrylic acid esters of polyhydric alcohols are 2-hydroxyethyl methacrylate, 3-hydroxypropyl methacrylate, 2-hydroxypropyl methacrylate, 4-hydroxybutyl methacrylate, 5-hydroxypentyl methacrylate, 2,2-dimethyl-3-hydroxypropyl methacrylate, diethylene glycol monomethacrylate, trimethylolpropane monomethacrylate, pentaerythritol monomethacrylate, 2-hydroxyethyl acrylate, 3-hydroxypropyl acrylate, 2-hydroxypropyl acrylate, 4-hydroxybutyl acrylate, 5-hydroxypentyl acrylate, 2,2-dimethyl-3-hydroxypropyl acrylate, diethylene glycol monoacrylate, trimethylolpropane monoacrylate, and pentaerythritol monoacrylate.

The comonomer that can be copolymerized with the monoacrylate or monomethacrylate of the polyhydric alcohol can by any addition-polymerizable monomer. Monomers containing a vinyl or vinylidene group are especially preferred. Examples of these copolymerizable monomers are acrylamides and methacrylamides such as acrylamide, methacrylamide, diacetone acrylamide or acryloyl morpholine; alkyl acrylates and methacrylates such as methyl methacrylate, ethyl methacrylate, propyl acrylate, propyl methacrylate, chloroethyl acrylate, chloroethyl methacrylate, butyl acrylate, pentyl methacrylate, hexyl acrylate, or hexyl methacrylate; vinyl esters such as vinyl acetate, vinyl propionate, vinyl butyrate or vinyl benzoate; vinyl ethers such as chloroethyl vinyl ether or butyl vinyl ether; styrenes such as styrene, chlorostyrene, methoxystyrene, methylstyrene, chloromethylstyrene or dichlorostyrene; acrylonitrile, methacrylonitrile, vinyl pyrrolidone, vinyl imidazole, vinyl chloride vinylidene chloride, methyl vinyl ketone, vinyl pyridine, vinyl methyl pyridine, vinyl ethyl pyridine, vinyl methyl imidazole, a diacrylate or dimethacrylate of an aliphatic polyhydric alcohol such as of the aliphatic polyhydric alcohols described above. These monomers can be copolymerized with the above monoacrylates or monomethacrylates above or in a combination of two or more. The ratio of the above monoacrylate or monomethacrylate to be copolymerized is 50 mol% or more, preferably 60 mol% or more. A suitable molecular weight of the copolymer is generally at least about 10,000, preferably 50,000 to 600,000.

The polymer to which the above monoacrylate or monomethacrylate is to be grafted is preferably gelatin, polyvinyl alcohol, polyacrylamide, carboxymethyl cellulose, starch, or hydroxyethyl cellulose, for example. These polymers can be coated from solutions in various solvents. Preferred solvents include, for example, ethanol, methyl ethyl ketone, a mixture of methanol and water, a mixture of ethanol and water, a mixture of propanol and water, a mixture of acetone and water, or a mixture of methyl ethyl ketone and water. Where the solvent is a mixture containing water, an especially preferred water content is 20 to 80% by volume.

A suitable thickness of the spacer layer is about 3 to 20 microns, but the thickness can be adjusted depending on the purpose.

The polymer mordant for the image-receiving layers, which is an important characteristic in the present invention, is described below in detail.

The polymer mordant used in this invention is a polymer compound containing therein the structural unit expressed by the following general formula (I);

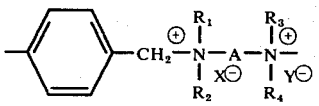

(I)

wherein each of $R_1$, $R_2$, $R_3$ and $R_4$ is an alkyl group, a hydroxyalkyl group or an aralkyl group; $R_1$ and $R_3$ and/or $R_2$ and $R_4$ can each combine to form an alkylene group such as an ethylene group of isopropylene group; A is an alkylene group, an arylene group (e.g., a phenylene group, a naphthylene group) or a group of the formula

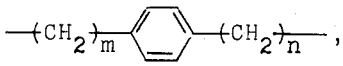

in which *m* and *n* each represents 0 or an integer of at least 1, preferably an integer of 1 to 3, and at least one of *m* and *n* is an integer of at least 1; and $X^{\ominus}$ and $Y^{\ominus}$ each represents a monovalent anion preferably, a photographically inert ion such as a halogen ion (e.g., chlorine, bromine, iodine), a nitrate ion, an alkylsulfate ion, and most preferably, chlorine ion.

In the above general formula (I), preferred groups represented by $R_1$, $R_2$, $R_3$ and $R_4$ are those groups containing 1 to 10 carbon atoms. Suitable examples of alkyl groups are methyl, ethyl, propyl, isopropyl, n-butyl, isobutyl, n-pentyl, isopentyl, and n-hexyl groups. Suitable examples of hydroxyalkyl groups are hydroxyethyl, hydroxypropyl, hydroxybutyl, hydroxypentyl, hydroxyhexyl, hydroxyoctyl and hydroxydecyl groups. Suitable examples of the aralkyl group are benzyl and phenethyl groups.

In the above general formula (I), A represents an alkylene group such as a methylene, trimethylene, isopropylene, tetramethylene or hexamethylene group, an arylene group such as a phenylene or naphthylene group, or a group of the formula

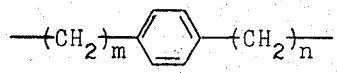

in which either *m* or *n* is 0 or an integer of at least 1, preferably an integer of 1 to 3, and the other is an integer of at least 1, preferably an integer of 1 to 3. Furthermore, $X^{\ominus}$ and $Y^{\ominus}$ each represent a monovalent anion. Preferred anions are those which are photographically stable, for example, halogen ions such as a chlorine, bromine or iodine ion, nitrate ion, or an alkylsulfate ion. Preferred ions are halogen ions, and chlorine ion is most preferred.

The manner in which the recurring unit of the above structure is present in the main chain of the polymer mordant is not limited, although a polymer mordant containing recurring units only of the above structure are preferred. The molecular weight of the polymer is not restricted and can vary, but polymers having a molecular weight of about 1,000 to about 100,000 are especially preferred.

Of the polymer mordants expressed by the above general formula (I), those which are especially preferred are polymers containing a recurring structural unit expressed by the following general formula (II);

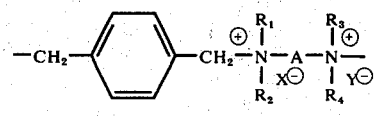

(II)

wherein $R_1$, $R_2$, $R_3$, $R_4$, A, $X^{\ominus}$ and $Y^{\ominus}$ are the same as defined with respect to the general formula (I). Specific examples of polymer mordants which can be used in this invention are shown below where *p* represents the degree of polymerization.

1.

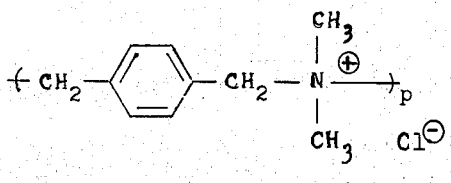

p = 200

2.

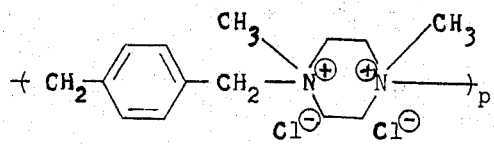

p = 100

3.
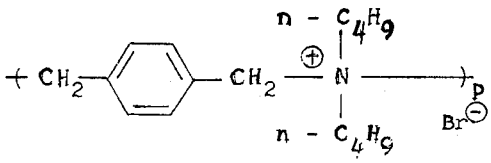
p = 50
4.
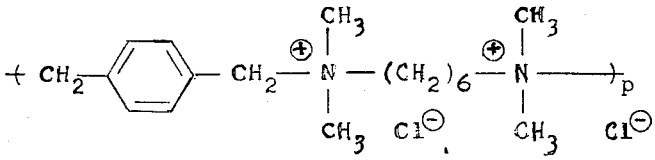
p = 40
5.
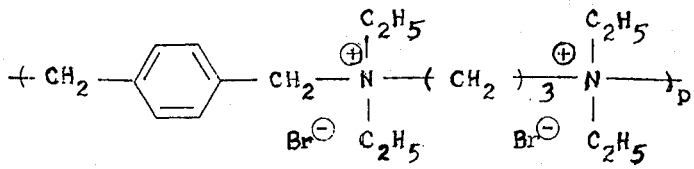
P = 40
6.
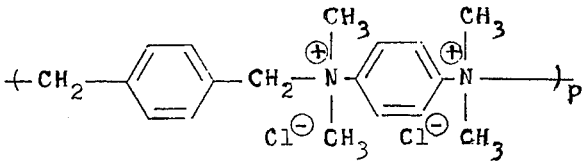
p = 20
7.
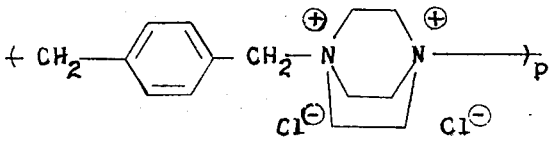
p = 60
8.
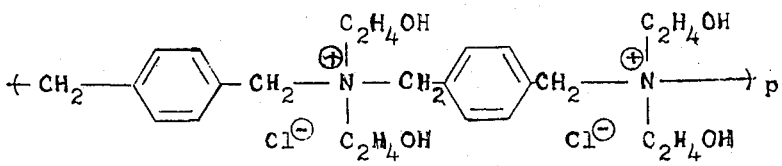
p = 30

9.

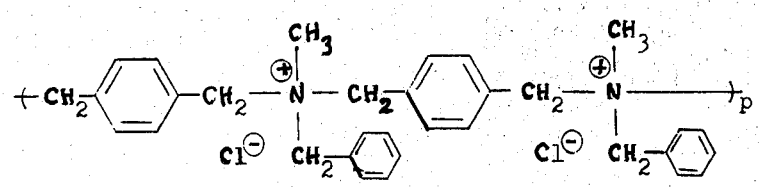

p = 10

10.

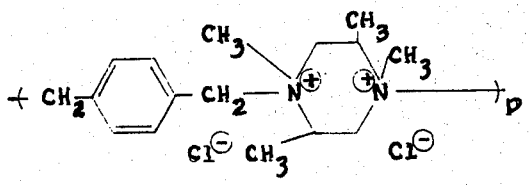

p = 15

A polymer mordant of this type, as shown, for example, in *Journal of Macromolecular Science*, Chemistry, Vol. 87 (1969) or *Journal of Polymer Science*, B-7, 383 (1969), can be easily obtained by reacting a p-xylylene dihalide, particularly p-xylylene dichloride, with a tertiary diamine in an organic solvent, particularly dimethylformamide, dimethyl sulfoxide, ethanol, methanol, acetonitrile, or dioxane, etc.

It is appropriate to coat the polymer mordant as a solution at a concentration of about 2 to 20% by weight on a support coated with the acidic polymer layer and the neutralization rate-regulating layer as described above, but it can also be directly coated on the support without the formation of these interlayers. Alternatively, the polymer mordant can be first dissolved in the processing liquid, and coated on the support simultaneously with the developing of the processing liquid. The polymer mordant used in this invention is water-soluble, and can be coated as an aqueous solution. Alternatively, the polymer mordant can also be applied as a solution in an organic solvent such as methanol, ethanol, acetone or methyl ethyl ketone, a mixture of these solvents, or a mixture of an organic solvent with water.

The polymer mordant used in this invention can be formed into a dyeable film by itself, but can be used together with a water-soluble polymer such as gelatin, polyvinyl alcohol, carboxymethyl cellulose, hydroxyethyl cellulose, starch, polyacrylamide or polyvinyl pyrrolidone in various mixing ratios. Suitable mixing ratios are those ratios in which the proportion of the polymer mordant in the image-receiving layer is about 10 to 100% by weight. The thickness of the image-receiving layer coated can be varied depending on the purpose desired, but the optimum thickness is about 3 to 10 microns. Best results are obtained when the polymer mordant is used in conjunction with polyvinyl alcohol.

The uppermost coated layer from the support of the image-receiving material described above is placed face to face with the uppermost coated layer of the support of a photographic element for color diffusion transfer, and an alkaline processing agent is spread therebetween to develop the silver halide emulsion and to transfer a color image-forming substance obtained by the reaction of a dye developer or coupler to the image-receiving layer.

The photographic element for color diffusion transfer comprises at least one silver halide emulsion layer formed on a support and a dye image former in combination with the silver halide. It is especially desirable that a red-sensitive emulsion layer, a green-sensitive emulsion layer and a blue-sensitive emulsion are superimposed sequentially on a support. Correspondingly, a cyan dye image former, a magenta dye image former, and a yellow dye image former are incorporated in these emulsion layers. If desired, additional layers such as a yellow filter layer, an antihalation layer, an intermediate layer or a protective layer can also be formed.

The support described above is a substantially planar substance which does not undergo marked dimensional changes during processing with a processing composition. For some purposes, a rigid support such as glass can be used, but generally flexible supports are useful. Flexible supports which can be advantageously used in this invention are those used generally in photographic materials, such as a cellulose nitrate film, a cellulose acetate film, polyvinyl acetal film, a polycarbonate film, a polyethylene terephthalate film or a polycarbonate film. Supports having good dimensional stability and oxygen-impermeability, such as a laminate of a polyvinyl alcohol layer interposed between polyethylene terephthalate layers or cellulose acetate layers are especially desirable because they contribute to good dimensional stability and reduced staining of the dye images. In order to facilitate the dissipation of the water of the spread processing composition through the support after treatment, the use of a water vapor-permeable support, such as those disclosed in U.S. Pat. No. 3,573,044, is advantageous. In order to prevent the silver halide emulsion layer from being affected by light striking the transparent support parallel to the plane of the support when a film unit is processed in a bright place, the transparent support is desirably colored to an extent that imagewise exposure and observation is not obstructed, but the transmission of light in the planar direction is prevented. If desired, the support can contain a plasticizer such as a phosphoric acid ester or a phthalic acid ester, an ultraviolet absorber such as 2-(2-hydroxy-4-t-butylphenyl) benzotriazole, or an antioxidant such as a hindered phenol. In order to maintain good adhesion between the support and a layer containing a hydrophilic polymer, it is advantageous to provide a primer layer or pretreat the surface of the support using corona discharge, ultraviolet irradiation, or flame treatment, etc. The thickness of the support is normally about 20 to 300 microns.

The dye image former is a compound which as a result of the development of a silver halide emulsion subjected to imagewise exposure, provides a two dimensional distribution of a diffusible dye correspondingly to the degree of exposure. Various dye image formers based on various methods of inducing the formation of diffusible dyes by the development of silver halide are known. Examples include (i) the type wherein as a result of the oxidation of the dye image former by silver halide, the diffusibility of the dye image former is changed, (ii) the type wherein a product obtained by the oxidation of silver halide reacts with the dye image former to release a diffusible dye, and (iii) the type wherein the oxidized dye image former reacts with an auxiliary chemical to release a diffusible dye. In addition to these types in which the oxidation with silver halide directly leads to the formation of a diffusible dye, other examples involving types wherein an image of a diffusible dye is formed from components which remain unconsumed in development and subsequent reactions taking place together with the development are known. These examples include (iv) the type wherein a llimited amount of a developer is used, and a portion of the developer which was not used in the development diffuses to the image-receiving layer to convert the dye former into a dye, (v) the type wherein a limited amount of a developer is used, and a portion of the developer which was not used in the development reacts with a dye image former to provide a diffusible dye, (vi) the type wherein a limited amount of a component reactive with the oxidation product of a developer, such as a coupler, is used and the reactive component which remains unused in the subsequent reactions following the development diffuses to the image-receiving layer to convert the dye former to a dye, and (vii) the type wherein a diffusible dye is provided by reaction with a silver ion dye image former obtainable from silver halide not used in development. Also (viii) the type wherein by the development of silver halide grains, a mordant is formed or destroyed around the grains whereby a diffusible dye is fixed or released is known.

The dye image former can include a completed dye structure or the dye structure can be formed during development and the subsequent steps which take place during the development period. Alternatively, components necessary for the formation of a dye migrate to the image-receiving layer where a dye is formed.

The dye image former itself is desirably non-diffusible in the photographic element during the production, storage and exposure of the photographic material, but can have various forms of diffusibility depending on the type of distribution of a dye image at the stages of development and diffusion transfer. In one form, the dye image former which is soluble and diffusible in the processing composition has a reduced diffusibility as a result of development and is consequently fixed, and the dye image former in the undeveloped area is transferred to the image-receiving layer. In another form, the dye image former itself is non-diffusible in the processing composition, but as a result of development, a diffusible dye or a precursor of a diffusible dye is released by the dye image former.

As described above, dye image formers of various combinations of the type of conversion from development to dyes, the stage of forming a dye structural moiety, and their diffusibility can be used. Especially useful dye image formers are exemplified as follows:

A. Dye Developers:

As disclosed in U.S. Pat. No. 2,983,606, dye developers are compounds which contain both a dye structural moiety and a silver halide developer group in the same molecule. When a dye developer and alkali act on an exposed silver halide photographic emulsion, the reduction of the silver halide and the oxidation of the dye developer take place at the same time. The oxidized dye developer has low solubility and diffusibility in the processing composition as compared with the original dye developer of the reducible form, and is fixed near the reduced silver halide. In a preferred form, the dye developer is substantially insoluble in an acidic or neutral aqueous medium, but the dye developer contains at least one dissociable residue sufficient to render the dye developer soluble and diffusible at the alkalinity of the processing composition. Such a dye developer can be incorporated in a photographic element, especially in a silver halide emulsion layer or a layer adjacent thereto. If the dye developer is diffused and transferred from a photographic element having at least two photographic units composed of a silver halide emulsion and a dye developer having absorption characteristics corresponding to the light sensitive wavelength region of the silver halide emulsion to one image-receiving element, a multi-colored positive image can be obtained in one development. The light absorption of the dye developer is advantageously one which enables color reproduction by the subtractive method to be achieved, that is, provides yellow, magenta and cyan images. The dye structural moiety which provides these absorptions is derived, for example, from an azo dye, an anthraquinone dye, a phthalocyanine dye, a nitro dye, a quinoline dye, an azomethine dye, an indamine dye, an indoaniline dye, an indophenol dye, or an azine dye.

On the other hand, the silver halide developer group is a group capable of developing exposed silver halide, preferably a group whose hydrophilicity is lost as a result of oxidation. Generally, a benzenoid developer group, that is, an aromatic developer group which forms a quinoid structure, when oxidized. One preferred developer group is a hydroquinonyl group, and other suitable developer groups include, for example, an ortho-dihydroxyphenyl group and ortho- and para-amino-substituted hydroxyphenyl groups. In a preferred dye developer, the dye structural moiety is isolated from the developer group by a saturated aliphatic group such as an ethylene group so that the dye structural moiety and the developer group cannot conjugate electronically. A 2-hydroquinonyl ethyl group and a 2-hydroquinonyl group are especially useful. The dye structural moiety can be linked to the developer group by a covalent bond. They can also be linked to each other by a coordination bond as is disclosed in U.S. Pat. Nos. 3,551,406, 3,563,739, 3,597,200 and 3,674,478. Furthermore, depending on the purpose of use of the diffusion transfer color photographic material and its construction, it is advantageous that the dye structural moiety is reduced to convert it temporarily to a colorless leuco form as disclosed in U.S. Pat. No. 3,320,063; and that, as disclosed in U.S. Pat. Nos. 3,230,085 and 3,307,947, the hydroxyl group or amino group of an auxochrome is acylated to shift the absorption temporarily to a short wavelength side. Dye developers having a dye structural moiety in which a hydroxyl group is present at the ortho-position of an azo linkage is useful in that these dye developers have superior absorption characteristics and color image stability as disclosed in U.S. Pat. No. 3,299,041. Other dye developers suitable for use in diffusion transfer color photography are disclosed in U.S. Pat. Nos. 2,983,605, 2,992,106, 3,047,386, 3,076,808, 3,076,820, 3,077,402, 3,126,280, 3,131,061, 3,134,762, 3,134,765, 3,135,604, 3,136,605, 3,135,606, 3,135,734, 3,141,772, 3,142,565, 3,173,906, 3,183,090, 3,246,985, 3,230,086, 3,309,199, 3,230,083, 3,239,339, 3,347,672, 3,347,673, 3,245,790 and 3,230,082.
Specific examples of dye developers suitable for use in diffusion transfer color photographic materials are described below.
4-[p-(β-Hydroquinonylethyl)phenylazo]-3-(N-n-hexylcarbomoyl)-1-phenyl-5-pyrazolone
2-[p-(β-Hydroquinonylethyl)phenylazo]-4-isopropoxy-1-naphthol
1,4-bis-[β-(Hydroquinonyl-α-methyl)-ethylamino]-5,8-dihydroxyanthraquinone
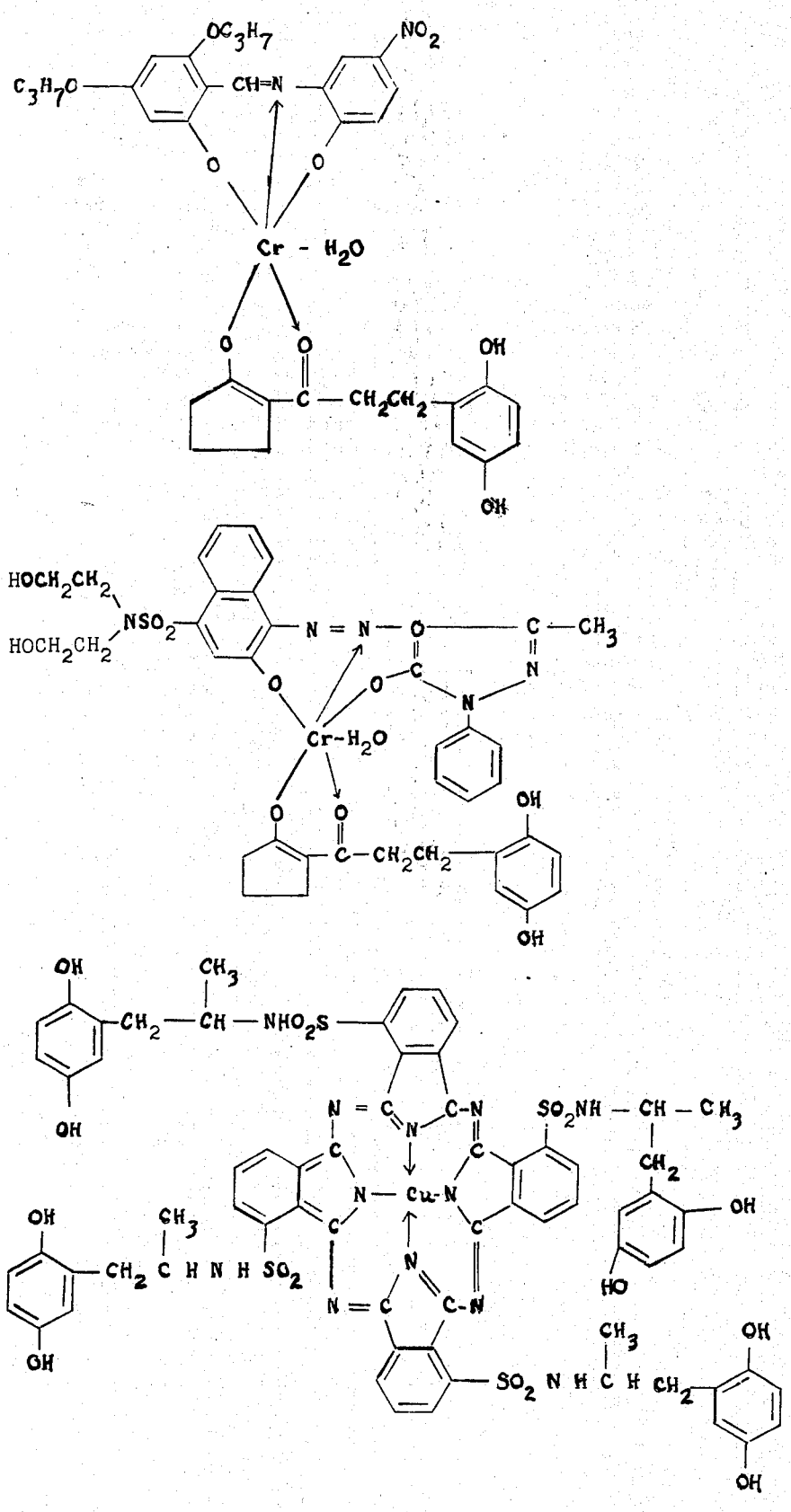

Auxiliary developing agents can be advantageously used in order to perform development rapidly in diffusion transfer color photography using a dye developer as a dye image former. For this purpose, a developer such as 1-phenyl-3-pyrazolidone as disclosed in U.S. Pat. No. 3,039,869, a hydroquinone derivative such as 4′-methylphenylhydroquinone or t-butyl hydroquinone, or a catechol derivative as disclosed in U.S. Pat. No. 3,617,277 can be used in a liquid processing composition. Alternatively such an auxiliary developing agent can be incorporated in a photographic element, especially in a silver halide emulsion layer, a layer containing the dye developer, or in a protective layer which is an interlayer or uppermost layer. In order to promote the development further and also promote diffusion transfer, an onium compound, such as N-benzyl-α-picolinium bromide, as disclosed in U.S. Pat. No. 3,173,786, can be present.

B. Diffusible Dye Releasing Couplers:

Diffusible dye releasing couplers are reactive non-diffusible compounds capable of coupling with the oxidized developer, and can liberate and release a soluble and diffusible dye in the development processing composition as a result of the coupling reaction. A first type of coupler compound capable of releasing a diffusible dye contains a structural moiety in which the site of the coupling reaction is substituted by a residual group split off by the oxidized developer. The electron conjugated system in the dye to be released can be present in the structure of the coupler in advance, or can be formed by the coupling reaction. The former is to be called the "pre-formed type". and the coupler exhibits a spectral absorption near the spectral absorption of the dye to be released. On the other hand, the latter is to be called the "instantaneously formed type", and the coupler is substantially colorless. Even a colored coupler exhibits an absorption which does not directly relate to the absorption of the dye to be released but is temporary.

Typical examples of couplers capable of releasing a diffusible dye can be expressed by the following general formula;

1. (Cp-1)-L-(Fr) ("pre-formed type") and
2. (Cp-2)-L-(Bl) ("instantaneously formed type")

In the above formula, Cp-1 represents a coupling-reactive structural moiety in which the coupling site is substituted with an (Fr)-L- residue, and at least one non-coupling site contains a hydrophobic group of at least about 8 carbon atoms and is substituted with a group capable of rendering the coupler molecule diffusion resistant, Cp-2 represents a coupling-reactive structural moiety in which the coupling site is substituted with a (Bl)-L- residue, with the proviso that when the compound of the general formula (2) is used in conjunction with a developer which does not contain a water-solubilizing group, the Cp-2 group has a water-solubilizing groups in at least one of the non-coupling sites; (Fr)-L- and (Bl)-L-represent groups capable of being split off by the oxidized developer; Fr represents a dye structural moiety having an absorption in the visible wavelength region and containing at least one water-solubilizing group; and Bl represents a group containing a hydrophobic group with at least about 8 carbon atoms and capable of rendering the coupler molecule diffusion resistant.

The coupling-reactive structural moieties utilized in Cp-1 and Cp-2 can, for example, be a number of different types of functional groups known to be capable of oxidative coupling with aromatic primary amino dye developers, for example, such as phenols, anilines, cyclic or aliphatic active methylene compounds, and hydrazones. Specific examples of the especially useful reactive structural moieties are residues derived from an acylamino-substituted phenol, 1-hydroxyl-2-naphthoic acid amide, N,N-dialkyl-anilines, 1-aryl-5-pyrazolones in which the 3-position of the pyrazolone is substituted with an alkyl, aryl, alkoxy, aryloxy, amino, acylamino, ureido or sulfonamido group, a pyrazolobenzoimidazole, a pyrazolotriazole, an α-cyanoacetophenone, or an α-acylacetanilide.

Examples of the connecting group L whose linkage with the coupler structural moiety is split by the oxidized developer include azo, azoxy, mercuryl (—Hg—), oxy, thio, dithio, triazolyl, diacylamino, acylsulfonamino

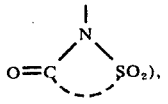

acyloxy, sulfonyloxy, and alkylidene groups. Of these, the oxy, thio, dithio, diacylamino, and acyloxy to be split off as anions are especially useful because the release of large amounts of diffusible dyes can be achieved when these groups are employed. The coupling site of a phenol or naphthol is preferably substituted with a group to be linked with an oxy, thio or diacyloxy group; the coupling site of a pyrazolone is preferably substituted with an azo, thio or acyloxy group; and the coupling site of an acylacetanilide is preferably substituted with an oxy, thio or diacylamino group.

Typical examples of the dye structural moieties represented by Fr are residues derived from azo, azomethine, indoaniline, indophenol, anthraquinone, nitro and azine dyes.

The hydrophobic group contained in the residue represented by Cp-1 and Bl provides a cohesive force to the coupler molecule in aqueous medium and renders the coupler molecule non-diffusible in a hydrophilic colloid forming the photographic material. Advantageously used hydrophobic groups include, for example, substituted or unsubstituted alkyl, alkenyl, aralkyl and alkaryl groups containing at least about 8 carbon atoms. Specifically, groups which can be used are, for example, lauryl, stearyl, oleyl, 3-n-pentadecylphenyl, and 2,4-di-t-amylphenoxy groups. Such a hydrophobic residue is bonded to the coupling basic structural moiety directly or through a divalent bond such as an amine, ureido, ether, ester or sulfonamido bond to form Cp-1. Furthermore, such a hydrophobic residue forms Bl by itself, or can be bonded to a residue such as an aryl or heterocyclic group directly or through the above described divalent bond.

The water-solubilizing group contained in the residue represented by Cp-2 or Fr is an acidic group which substantially dissociates in the processing composition or a precursor group capable of forming such a group by hydrolysis. Acidic groups having a pKa of not more than about 11 are especially useful. Examples of such acidic groups are sulfo, sulfate ester (—O—$SO_3H$), carboxyl, sulfonamido, diacylamino, cyanosulfonamino, and phenolic hydroxyl groups.

When the coupler capable of releasing a diffusible dye, which is of the type expressed by general formula (1), reacts with the oxidized developer, the bond L is cleaved to form a non-diffusible condensation product between Cp-1 and the developer and a soluble dye containing the Fr structural portion. The soluble dye diffuses to the image-receiving layer to form a dye image.

When the coupler capable of releasing a diffusible dye, which is of the type expressed by general formula (2), reacts with the oxidized developer, the bond L is cleaved to form a soluble dye which is an oxidative coupling reaction product formed between Cp-2 and the developer and a non-diffusible liberation product derived from (Bl)-L-. The soluble dye diffuses to the image-receiving layer to form a dye image.

Specific examples of diffusible dye-releasing couplers of the type expressed by the general formula (1) are shown below.

α-[4-(8-Acetamido-3,6-disulfo-1-hydroxy-2-naphthylazo)-phenoxyl]-α-pivalyl-4-(N-methyl-N-octadecylsulfamyl)acetanilide disodium salt 1-(p-t-Butylphenoxyphenol)-3-[α-(4-t-butylphenoxy)propionamido]-4-(2-bromo-4-methylamino-5-sulfo-1-anthra-9,10-quinalyl-azo)-5-pyrazolone 1-Hydroxy-4-{3-[4-N-ethyl-N-β-sulfoethylamino)-2-methyl-phenylazo]phenylazo}-N-[8-(2,4-di-t-amylphenoxy)butyl]-2-naphthamide sodium salt Specific examples of the diffusible dye-releasing couplers of the type expressed by the general formula (2) are shown below.

α-(4-Methoxybenzoyl)-α-(3-octadecylcarbamyl-phenylthio)-3,5-dicarboxyacetanilide 1-Phenyl-3-(3,5-dicarboxyanilino)-4-(3-octadecylcarbamyl-phenylthio)-5-pyrazolone 1-Phenyl-3-(3,5-disulfobenzoylamino)-5-(2-hydroxy-4-n-pentadecylphenylazo)-5-pyrazolone 1-[4-(3,5-Dicarboxybenzamido)phenyl]-3-ethoxy-4-(3-octadecylcarbamylthio)-5-pyrazolone 1-Hydroxy-4-(3-octadecylcarbamylphenylthio)-N-ethyl-3′,5′-dicarboxy-2-naphthoanilide 1-Hydroxy-4-(n-octadecylsuccinimido)-N-ethyl-3′,-5′-dicarboxy-2-naphthalide.

Other examples of diffusible dye-releasing couplers and methods of their preparation are described, for example, in British Pat. Nos. 840,731, 904,364 and 1,085,631, and U.S. Pat. Nos. 3,476,563, 3,644,498, and 3,419,391.

In the case of the second type coupler capable of releasing a diffusible dye, a condensation reaction of the coupler with the oxidized developer occurs, and subsequently it induces an intramolecular cyclization reaction with a substituent at a position adjacent the reaction site, whereby the dye residue contained in the substituent is split off and released. An especially useful reaction is one wherein an aromatic primary amino developer is oxidatively coupled with the 4-position of phenol or aniline, and then an azine ring is formed between it and a sulfonamido group containing a dye structural moiety located at the 3-position, thereby to release a diffusible dye containing sulfonic acid. Specific examples of compounds of this type are as follows.

1-Phenyl-3-ethylcarbamyl-4-{2-methoxy-4-[N-n-dodecyl-N-(1-hydroxy-4-chloro-3-naphthyl)-sulfamylphenylazo}-5-pyrazolone 2-(β-Octadecylcarbamoylethyl)-4-{2-[4-(2-hydroxy-1-naphthlazo)phenylsulfonamido]-anilino}-phenol.

The aromatic primary amino developer which can be used in conjunction with the diffusible dye-releasing couplers is advantageously a p-aminophenol, a p-phenylenediamine, or a derivative thereof. Examples of especially useful aromatic primary amino developers include 2-chloro-4-aminophenol, 2,6-dibromo-4-aminophenol, 4-amino-N,N-diethyl-3-methylaniline, N,N-diethyl-p-phenylene diamine, N-ethyl-β-methanesulfonamidoethyl-3-methyl-4-aminoaniline, 4-amino-N-ethyl-N-(δ-sulfobutyl)-aniline, 4-amino-N-ethyl-N-(β-hydroxyethyl)aniline, 4-amino-3-methyl-N-ethyl-N-(β-hydroxyethyl)aniline, 4-amino-N-ethyl-N-(β-carboxyethyl)aniline, 4-amino-N-N-bis(β-hydroxyethyl)-3-methylaniline, 3-acetamido-4-amino-N,N-(β-hydroxyethyl)aniline, 4-amino-N-ethyl-N-(2,3-dihydroxypropyl)-3-methylaniline, 4-amino-N,N-diethyl-3-(3-hydroxypropoxy)aniline, 4-amino-N-ethyl-N-(β-hydroxyethyl)-3-methoxyaniline, and salts formed between these anilines and acids such as hydrochloric acid, sulfuric acid, oxalic acid or p-toluenesulfonic acid. Furthermore, precursors of developers such as Schiff bases of these anilines or the phthalic acid imides are useful since they can be incorporated in the photographic elements.

A negative-type silver halide emulsion layer containing a diffusible dye-releasing coupler provides a negative diffusion transfer dye image as a result of developing processing. On the other hand, a direct positive silver halide emulsion layer containing a diffusible dye-releasing coupler provides a positive diffusion transfer dye image. Useful direct positive emulsions include, for example, the inner latent image type emulsion disclosed in U.S. Pat. Nos. 2,592,250, 2,588,982 and 3,227,552, and the fogged-type emulsions disclosed in British Pat. Nos. 444,245 and 462,730 and U.S. Pat. Nos. 2,005,837, 2,541,472 and 3,367,778. A positive diffusion transfer dye image can be obtained by processing a layer containing a diffusible dye-releasing coupler and physical development nuclei, which layer is provided adjacent the negative-type silver halide emulsion layer, with a developer solution containing a solvent for silver halide. A reversal dye image-forming technique utilizing this physical development is, for example, disclosed in British Pat. No. 904,364. Furthermore, a photographic element in which a layer containing a diffusible dye-releasing coupler and a spontaneously reducible metal salt is provided adjacent a negative-type silver halide emulsion layer containing a compound (a development-inhibitor releasing, DIR, compound) releasing a development inhibitor such as 1-phenyl-5-mercaptotetrazole upon reaction with an oxidized product of the developer gives a positive diffusion transfer dye image as disclosed in U.S. Pat. Nos. 3,227,551, 3,227,554 and 3,364,022, and German OLS 2,032,711. In the present invention, these combinations of emulsions and dye image formers can be used, and depending on the purpose, the negative dye image-forming method or the positive dye image-forming method can be selected.

C. Reducing Agents Capable of Releasing a Diffusible Dye:

In addition to the use of the above-described dye developer and diffusible dye-releasing coupler, if a reducing agent oxidized as a result of development is subjected to an intramolecular reaction or reacted with an auxiliary material in the solution to release a diffusible dye, the dye image former can be advantageously used. In order to effect dye image formation of this type, it is advantageous to oxidize the dye image former using an auxiliary developing agent such as a hydroquinone or a 3-pyrazolidone. The oxidized dye image former releases a diffusible dye by the action of the auxiliary material, such as a hydroxyl ion or sulfite ion, present in the processing composition or the photographic element. Specific examples of dye image forming agents of this type are disclosed in United States Pat. Nos. 3,585,026 and 3,698,897 and German OLS 2,242,762.

The dye image former used in this invention can be dispersed in a hydrophilic colloid as a carrier using various methods depending on the type of dye image former. For example, a diffusible dye-releasing coupler containing a dissociable group such as a sulfo or carboxyl group can be added to a hydrophilic colloid solution after being dissolved in water or an alkaline aqueous solution. A dye image former which is not easily soluble in an aqueous medium but is readily soluble in an organic solvent is first dissolved in an organic solvent, and the resulting solution is added to a hydrophilic colloid solution and by stirring, for example, is dispersed as fine particles. Examples of suitable solvents are ethyl acetate, tetrahydrofuran, methyl ethyl ketone, cyclohexanone, β-butoxy-β-ethoxyethyl acetate, dimethylformamide, dimethyl sulfoxide, and 2-methoxyethanol tri-n-butyl phthalate. Of these dispersing solvents, those solvents having a relatively high vapor pressure can be volatilized during the drying of the photographic layer or can be volatilized, prior to coating, using the methods disclosed, for example, in U.S. Pat. Nos. 2,322,027 and 2,801,171. Of these dispersing solvents, those solvents which are readily soluble in water can be removed using the washing methods described, for example, in U.S. Pat. Nos. 2,949,360 and 3,396,027. In order to stabilize the dispersion of the dye image former and promote the process of dye image formation, it is advantageous to incorporate a solvent which is substantially water-insoluble and has a boiling point of at least 200° C at atmospheric pressure in the photographic element together with the dye image former. Examples of high-boiling solvents suitable for this purpose include fatty acid esters such as a triglyceride or dioctyl adipate, phthalic acid esters such as di-n-butyl phthalate, phosphoric acid esters such as tri-o-cresyl phosphate or tri-n-hexyl phosphate, amides such as N,N-diethyllauryl amide, or hydroxy compounds such as 2,4-di-n-amylphenol. Furthermore, in order to stabilize the dispersion of the dye image former and promote the process of dye image formation, it is advantageous to incorporate a solvent soluble polymer into the photographic element together with the dye image former. Examples of medium-affinitive polymers are shellac, a phenol/formaldehyde condensate, poly(n-butyl acrylate), a copolymer of n-butyl acrylate and acrylic acid, and a copolymer of n-butyl acrylate, styrene and methacrylamide. Such a polymer can be dissolved together with the dye image former in an organic solvent, and then dispersed in a hydrophilic colloid. Alternatively, a hydrosol of the polymer prepared using means such as emulsion polymerization can be added to a dispersion of the dye image former in a hydrophilic colloid. Generally, the dispersion of the dye image former can be effectively achieved with a high shearing force. For example, the use of a high speed rotary mixer, colloid mill, high pressure milk homogenizer, the high pressure homogenizer disclosed in British Pat. No. 1,304,206, or an ultrasonic vibration emulsifying device. The dispersion of the dye image former is markedly facilitated by using a surface active agent as an emulsification assistant. Examples of surface active agents useful for dispersing the dye image former are sodium triisopropylnaphthalenesulfonate, sodium dinonylnaphthalenesulfonate, sodium p-dodecylbenzenesulphonate, sodium dioctylsulfosuccinate, sodium cetylsulfate, and the anionic surface active agents as disclosed in Japanese Pat. Publication No. 4,293/64. The combined use of such an anionic surface active agent and a higher fatty acid ester of anhydrohexitol exhibits particularly good emulsifying ability as is disclosed in U.S. Pat. No. 3,676,141.

The silver halide emulsion used in this invention is a colloidal dispersion of silver chloride, silver bromide, silver chlorobromide, silver iodobromide, silver chloroiodobromide or mixtures thereof. The proportion of the halogen is selected depending to the purpose of using the photographic material and the conditions for treating it. A silver iodobromide or silver chloroiodobromide emulsion having an iodide content of about 1 to 10 mol% and/or a chloride content of not more than about 30 mol% with the balance being bromide is especially preferred.

Preferably, the silver halide emulsion has an average grain size of about 0.1 micron to about 2 microns and depending upon the purpose of use, an emulsion containing silver halide having a uniform grain size is desirable. The grains can assume a cubic crystal configuration, an octahedral configuration or a mixed crystal configuration. These silver halide emulsions can be prepared, for example, using conventional techniques such as those described in P. Glafkides, *Chimie Photographique* 2nd Edition, Chapters 18 to 23, Paul Montel, Paris (1957). Specifically, a soluble silver salt such as silver nitrate is reacted with a water-soluble halogen compound such as potassium bromide in a protective colloid solution such as gelatin, and the crystals are grown in the presence of an excess of halide or a solvent for the silver halide such as ammonia. A precipitating method such as a single or double jet method or a pAg control double jet method can be used to produce the silver halide. The removal of soluble salts from the emulsion can be achieved by rinsing the cooled and coagulated emulsion, by dialysis of the emulsion, by addition of a precipitating agent such as an anionic surface active agent or an anionic polymer containing a sulfone group, a sulfate ester group or a carboxyl group, by pH adjustment, or by precipitation using an acylated protein such as phthaloyl gelatin as a protective colloid and pH adjustment.

It is desirable that the silver halide emulsion used in this invention is chemically sensitized by using a heat treatment together with the natural sensitizers contained in gelatin, a sulfur sensitizer such as sodium thiosulfate or N,N,N'-trimethylthiourea, a gold sensitizer such as a thiocyanate complex salt of monovalent gold or a thiosulfate complex salt of monovalent gold, or a reducing sensitizer such as stannous chloride or hexamethylene tetramine. In the present invention, emulsions which easily permit the formation of a latent image on the surface of the grains, and also emulsions which permit the formation of a latent image within the grains as disclosed in U.S. Pat. Nos. 2,592,550 and 3,206,313 can be used.

The silver halide emulsions used in this invention can be stabilized using an additive such as 4-hydroxy-6-methyl-1,3,3a,7-tetrazaindene, 5-nitroimidazole, 1-phenyl-5-mercaptotetrazole, 8 -chloromercuryl quinoline, benzenesulfinic acid or pyrocatechin. In addition, inorganic compounds such as cadmium salts, mercury salts, and complex salts of the platinum group elements such as a chloro complex salt of palladium are also useful for stabilizing the photographic material of this invention. Furthermore, the silver halide emulsion used in this invention can contain a sensitizing compound such as a polyethylene oxide compound.

If desired, the silver halide emulsion used in this invention can have its spectral sensitivity enhanced as a result of using an optical sensitizing dye. Useful optical sensitizers include, for example, cyanines, merocyanines, holopolar cyanines, styryls, hemicyanines, oxanols, and hemioxanols. Specific examples of optical sensitizers are described in P. Glafkides, supra, Chapters 35 to 41 and F. M. Hamer, *the Cyanine Dyes and Related Compounds* (Interscience). Cyanines in which the nuclear nitrogen atom is substituted with an aliphatic group containing a hydroxyl, carboxyl or sulfo group, for example, those described in U.S. Pat. Nos. 2,503,766, 3,459,553 and 3.177,210, are especially useful in the practice of this invention.

The layers which permit the permeation of the processing liquid used in this invention, such as the silver halide emulsion layer, the layer containing the dye image former, or an auxiliary layer such as a protective layer or interlayer contain a hydrophilic polymer as a binder. Examples of suitable hydrophilic polymers are proteins such as gelatin, casein, albumin, gelatin modified with, for example, an acylating agent or gelatin having a vinyl polymer grafted thereto, cellulose derivatives such as hydroxyethyl cellulose, methyl cellulose or carboxymethyl cellulose, polymeric non-electrolytes such as partially hydrolyzed products of polyvinyl acetate, polyvinyl pyrrolidone, or polyacrylamide, anionic synthetic polymers such as polyacrylic acid, a partially hydrolyzed product of polyacrylamide or a copolymer of vinyl methyl ether and maleic acid, and ampholytic synthetic polymers such as N-vinyl imidazole, a copolymer of acrylic acid and acrylamide, or polyacrylamide subjected to a Hofmann reaction treatment. These hydrophilic polymers can be used either alone or in admixture. Furthermore, these hydrophilic polymer-containing layers can contain a latex-like polymeric dispersion of a hydrophobic monomer such as an alkyl acrylate or alkyl methacrylate. These hydrophilic polymers, especially those containing a functional group such as an amino, hydroxyl or carboxyl group, can be rendered insoluble using various cross-linking agents without inducing the loss of their permeability by the processing liquid. Examples of especially useful cross-linking agents are aldehyde compounds such as formaldehyde, glyoxal, glutaraldehyde, mucochloric acid or an oligomer of acrolein; aziridine compounds such as triethylene phosphoramide disclosed in Japanese Pat. Publication No. 8,790/62; epoxy compounds such as 1,4-bis(2',3'-epoxypropoxy)diethyl ether disclosed in Japanese Pat. Publication No. 7,133,/59; active halogen compounds such as 2-hydroxyl-4,6-dichloro-S-triazine sodium salt disclosed in U.S. Pat. No. 3,325,287; active olefin compounds such as hexahydro-1,3,5-triacryl-S-triazine; methylol compounds such as N-polymethylol urea or hexamethylol melamine; and polymeric substances such as dialdehyde starch or 3-hydroxyl-5-chloro-S-triazinylated gelatin disclosed in U.S. Pat. No. 3,362,827. Furthermore, these hydrophilic polymer-containing layers can contain a cross-linking promotor such as a carbonate or resorcinol in addition to the cross-linking agent.

The photographic layer used in this invention can be coated using various coating methods, such as a dip method, a roller method, an air knife method, a bead coating method as described in U.S. Pat. No. 2,681,294, or a curtain method as described in U.S. Pat. Nos. 3,508,947 and 3,513,017. In the case of a multi-layered photographic element, it is convenient to apply a number of layers at the same time using the multislit hopper descrived in U.S. Pat. Nos. 2,761,417, 2,761,418, 2,761,419 and 2,761,791.

In order to facilitate the coating of the photographic layer used in this invention, it is advantageous for the coating composition to contain various surface active agents. Examples of useful surface active agents are nonionic surface active agents such as an ethylene oxide adduct of p-nonylphenol, an alkyl ether of sucrose or a monalkyl ether of glycerin, anionic surface active agents such as sodium dodecyl sulfate, sodium p-dodecylbenzenesulfonate or sodium dioctylsulfosuccinate, and amphoteric surface active agents such as carboxymethyldimethyllauryl ammonium hydroxide internal salt, DERIPHAT 151 trade name produced by General Mills, or betaine-type compounds as disclosed in U.S. Pat. No. 3,441,413, British Pat. No. 1,159,825, and Japanese Pat. Publication No. 21985/71.

In order to facilitate the coating of the photographic layer used in this invention, the coating composition can contain a viscosity increasing agent of various kinds. Useful viscosity-increasing agents include, for example, high-molecular-weight polyacrylamide which increases the viscosity of the coating composition due to its own viscosity, and anionic polymers which exhibit a viscosity-increasing activity due to interaction with the binder polymer in the coating composition, such as cellulose sulfate ester, poly-p-sulfostyrene potassium salt, and the acrylic polymers disclosed in U.S. Pat. No. 3,655.407.

The photographic element used in this invention is a combination of the silver halide emulsion and the dye image former. Depending on the color reproduction intended, a suitable combination of the spectral sensitivity of the silver halide emulsion and the spectral absorption of the dye image is selected. For the reproduction of natural colors a photographic element containing at least two combinations of an emulsion hving a selective spectral sensitivity in a certain wavelength range and a compound capable of forming a dye image and having a selective spectral absorption in the same wavelength range is used. In particular, photographic elements having a combination of a blue-sensitive silver halide emulsion and a compound capable of forming a yellow dye image, a combination of a green-sensitive emulsion and a compound capable of forming a magenta dye image, and a combination of a red-sensitive emulsion and a compound capable of forming a cyan dye image are useful. These combination units of emulsions and dye image formers are coated in a photographic element in layers in a face-to-face relation, or coated after particles of these are formed and mixed. In a preferred multi-layer construction, a blue-sensitive emulsion, a green-sensitive emulsion and a red-sensitive emulsion are sucessively arranged beginning at the side of the support of exposure to incident light. Especially when a high-sensitive emulsion containing an iodide is used, a yellow filter layer can be interposed between the blue-sensitive emulsion and the green-sensitive emulsion. The yellow filter layer contains a yellow colloidal silver dispersion, a dispersion of an oil-soluble yellow dye, an acid dye mortanted in a basic polymer or a basic dye mordanted in an acid polymer. It is advantageous that the emulsion layers are separated from one another by interlayers. These interlayers prevent any undesirable interaction that might occur between emulsion layer units of different color sensitivities. the interlayer is composed of, for example, a hydrophilic polymer such as gelatin, polyacrylamide, or a partially hydrolyzed product of polyvinyl acetate, a polymer having fine pores formed from a latex of a hydrophilic polymer and a hydrophobic polymer described in United States or a polymer whose hydrophilicity gradually increases according to the processing composition, such as calcium alginate as disclosed in U.S. Pat. No. 3,384,483. Furthermore, the interlayer can contain an agent for inhibiting the interaction between the layers, which is selected depending on the type of the dye image former and the processing composition used. For example, with a dye image former of the type which releases a diffusible dye by the oxidation product of the developer, a reducing agent such as an non-diffusible hydroquinone derivative and an non-diffusible coupler capable of being fixed by reaction with the oxidation product are effective for preventing the undesirable exchange of the oxidation product between the emulsion layer units. Furthermore, with the system wherein image reversal is carried out by a physical dissolution, the interlayer advantageously contains physical development nuclei such as colloidal metallic silver in order to obtain good color reproduction. With the system wherein image reversal is carried out using a development inhibitor-releasing compound, it is advantageous to for low-sensitivity fine particles of silver halide to be present in order to obtain good color reproduction.

The processing composition used in this invention is a liquid composition containing processing components required for the development of the silver halide emulsion and forming a diffusion transfer dye image. The solvent mainly is water, and can contain a hydrophilic solvent such as methanol or methyl cellosolve. The processing composition has a pH necessary for inducing the development of the emulsion layer, and alkali in an amount sufficient to neutralize the acid formed during the development and the formation of dye images. Examples of useful alkalis include sodium hydroxide, potassium hydroxide, a dispersion of calcium hydroxide, tetramethylammonium hydroxide, sodium carbonate, trisodium phosphate, and diethylamine, Preferably, the processing composition has a pH of at least about 12 at room temperature (about 20° to 30° C). More preferably, the processing composition contains a hydrophilic polymer of high molecular weight, such as polyvinyl alcohol, hydroxyethyl cellulose, sodium carboxymethyl cellulose etc. Such a polymer provides the processing composition with a viscosity of at least 1 poise, preferably about 1,000 poises, at room temperature, and not only facilitates the spreading of the processing composition uniformly, but also facilitates the formation of an integral film after the processing by forming a non-flowable film due to migration of the aqueous solvent to the photographic element and the image-receiving element during the course of the development. This polymer film can also serve to inhibit the further movement of the coloring image forming materials after the formation of a diffusion transfer dye image has been substantially completed, and therefore, to prevent a change in the image.

It is often advantageous for the treating composition to contain a light-absorbing substance such as carbon black, or a desensitizer as disclosed in U.S. Pat. No. 3,579,333, in order to prevent the silver halide emulsion from being fogged by ambient light during development. Furthermore, it is advantageous that the processing composition contains a treating component specific to the dye image former used. Examples of such processing components are an auxiliary developer such as para-aminophenol, 4′-methyl-phenyl hydroquinone or 1-phenyl-3-pyrazolidone, an onium development promotor such as N-benzyl-α-picolinium bromide or an antifoggant such as benzotriazole in the case of dye developers. In the case of diffusible dye-releasing couplers, examples of such processing components include developers such as aromatic primary amino color developers, an anti-oxidant such as a sulfite or ascorbic acid, an antifoggant such as a halide or 5-nitrobenzimidazole, and a solvent for silver halide such as a thiosulfate or uracil.

If a white color reflecting agent such as titanium dioxide is incorporated in the processing liquid, and a transparent support such as a polyethylene terephthalate film or cellulose triacetate film is used as the support of the image-receiving material, a positive image can be observed through the support without separating the image-receiving material from the negative material after the development by the processing liquid and the diffusion transfer. A suitable amount of the white color reflecting agent to be included in the processing liquid is about 20 to 60% of the total amount of the processing liquid, but there is no particular restriction on the amount which can be used. When a white color reflecting agent is not used, a positive image can be observed by separating the negative material from the image-receiving material after the exposure and transfer steps.

Advantageously, the processing composition is contained in a rupturable container. Such a container can be produced by folding a sheet of a material impervious to liquids and air, and sealing the edge portions. The treating composition is contained in the hollow portion thus formed. The container advantageously ruptures at a predetermined position due to the internal pressure of the processing composition when the film unit is passed through pressurizing members, and thus the contents are released. Materials such as a laminate of polyethylene terephthalate/polyvinyl alcohol/polyethylene or a laminate of lead foil/a copolymer of vinyl chloride and vinyl acetate can be advantageously used. It is desirable that such a container be fixed along the leading edge of the film unit in the direction of travel of the film unit in relation to the pressurizing member and the liquid contained therein is capable of being spread onto the surface of the photographic element in substantially one direction. Examples of preferred containers are disclosed in U.S. Pat. Nos. 2,543,181, 2,643,886, 2,653,732, 2,723,051, 3,056,492, 3,152,515 and 3,173,580.

The following Examples are given to illustrate the present invention in greater detail. Unless otherwise indicated, all parts, percents, ratios and the like are by weight.

EXAMPLES 1 TO 10

Image-Receiving Elements 1 to 10 for color diffusion transfer having a single image-receiving layer were prepared using the Polymer Mordants 1 to 10, respectively, in the following manner.

Preparation of Image-Receiving Material

A mixture of 100 g of an aqueous solution containing 3% by weight of each of the polymer mordants and 6% by weight of polyvinyl alcohol (GOSENOL GH-17, trade name for a product of Nippon Gosei Kagaku Kogyo) and 0.1 g of polyoxyethylene nonylphenyl ether was coated on a white paper support on which polyethylene had been laminated, and gelatin had been sub-coated thereon. An image-receiving layer having a dry thickness of 7 microns was formed.

Preparation of Photographic Element

The following layers were successively coated on a cellulose triacetate support to form a photographic element.

1. Cyan Dye Developer Layer 15 g of 1,4-bis(α-methyl-β-hydroquinonylpropylamino)5,8-dihydroxyanthraquinone was dissolved with heating in 70 cc of a mixed solution of 25 cc of N,N-diethyllauryl amide and 25 cc of methyl cyclohexanone and 1 g of sodium dioctyl sulfosuccinate. The resulting solution was dispersed and emulsified in 160 cc of a 10% by weight aqueous solution of gelatin containing 10 cc of a 5% by weight aqueous solution of sodium n-dodecylbenzenesulfonate. Water was added to adjust the total volume to 500 cc. The resulting coating solution was coated in a dry thickness of 5 microns.

2. Red-Sensitive Emulsion Layer

A red-sensitive silver iodobromide emulsion (containing 1 mol% of silver iodide) containing $5.5 \times 10^{-2}$ mol of silver and 5.0 g of gelatin per 100 g of the emulsion was coated in a dry thickness of 3.5 microns.

3. Interlayer 100 cc of a 5% by weight aqueous gelatin solution containing 1.5 cc of a 5% by weight aqueous solutin of sodium n-dodecylbenzenesulfonate was coated in a dry thickness of 1.5 microns.

4. Magenta Dye Developer Layer 10 g of 4-propoxy-2-[p-(β-hydroxyquinonylethyl)-phenylazo]-1-naphthol as a magenta dye developer was dissolved with heating in a mixed solvent of 20 cc of N-n-butylacetanilide and 25 cc of methyl cyclohexanone, and the solution was dispersed and emulsified in 120 cc of a 10% by weight aqueous solution of gelatin containing 8 cc of a 5% by weight aqueous solution of sodium n-dodecylbenzenesulfonate. Water was added to adjust the total amount to 500 cc. The resulting solution was coated in a dry thickness of 3.5 microns.

5. Green-Sensitive Emulsion Layer

A green-sensitive silver iodobromide emulsion (containing 2 mol% of silver iodide) comprising $4.7 \times 10^{-2}$ mol of silver and 6.2 g of gelatin per 100 g of the emulsion was coated in a dry thickness of 1.8 microns.

6. Interlayer 100 cc of a 5% by weight aqueous solution of gelatin containing 1.5 cc of a 5% by weight aqueous solution of sodium n-dodecylbenzenesulfonate was coated in a dry thickness of 1.0 micron.

7. Yellow Dye Developer Layer 10 g of 1-phenyl-3N-n-hexylcarboxyamido-4-[p-2′,-5′(dihydroxyphenethyl)phenylazo]-5-pyrazolone as a yellow dye developer was dissolved with heating in a mixed solvent of 10 cc of N-n-butyl acetanilide and 25 cc of cyclohexanone. The resulting solution was dispersed and emulsified in 100 cc of a 10% by weight aqueous solution of gelatin containing 8 cc of a 5% by weight sodium n-dodecylbenzenesulfonate. To the emulsion was added 5 cc of a 2% by weight aqueous solution of 2-hydroxy-4,6-dichloro-S-triazine, and water was added to adjust the total volume to 300 cc. The resulting solution was coated in a dry thickness of 1.5 microns.

8. Blue-Sensitive Emulsion Layer

A blue-sensitive silver iodobromide emulsion (containing 7 mol% of silver iodide) containing $3.5 \times 10^{-2}$ and 6.5 g of gelatin per 100 g of the emulsion was coated in a dry thickness of 1.5 microns.

9. Protective Layer

A 4% by weight aqueous solution of gelatin containing 2 cc of a 5% by weight solution of sodium n-dodecylbenzenesulfonate and 5 cc of 2% by weight mucochloric acid was coated in a dry thickness of 1 micron.

Testing was conducted as follows:

The photographic element was exposed (1) to blue light and to green light only, (2) to red light and blue light only, and (3) to red light and greenlight only, respectively.

A processing liquid of the following formulation was spread between the photographic element and the image-receiving element at a rate of 1.8 cc/100 cm², and diffusion transfer was performed for 40 seconds. Then, the image-receiving layer was peeled off.

| Formulation of the Processing Composition | |
|---|---|
| Water | 100 cc |
| Potassium Hydroxide | 11.2 |
| Hydroxyethyl Cellulose (Natrosol 250 HR, Hercules Incorporated) | 3.4 g |
| Benzotriazole | 3.5 g |
| N-Benzyl-α-picolinium bromide | 2.0 g |
| Zinc Nitrate | 0.5 g |

-continued

| Formulation of the Processing Composition | |
|---|---|
| Potassium Thiosulfate | 0.5 g |
| Lithium Nitrate | 0.5 g |

After diffusion transfer, the integral density in each of these areas was measured on the basis of the rate of reflection using red, green and blue filters. The results obtained are shown in the following.

| | Image-Receiving Element 1 Density | | |
|---|---|---|---|
| Type Exposure | Red Filter | Green Filter | Blue Filter |
| Blue and Green | 1.25 | 0.50 | 0.36 |
| Red and Blue | 0.10 | 0.90 | 0.60 |
| Red and Green | 0.07 | 0.15 | 0.99 |

| | Image-Receiving Element 2 Density | | |
|---|---|---|---|
| Type Exposure | Red Filter | Green Filter | Blue Filter |
| Blue and Green | 1.31 | 0.60 | 0.37 |
| Red and Blue | 0.10 | 0.98 | 0.58 |
| Red and Green | 0.07 | 0.20 | 1.12 |

| | Image-Receiving Element 3 Density | | |
|---|---|---|---|
| Type Exposure | Red Filter | Green Filter | Blue Filter |
| Blue and Blue | 0.56 | 0.41 | |
| 1.33 | | | |
| Red and Blue | 0.11 | 0.96 | 0.59 |
| Red and Green | 0.04 | 0.18 | 1.05 |

| | Image-Receiving Element 4 Density | | |
|---|---|---|---|
| Type Exposure | Red Filter | Green Filter | Blue Filter |
| Blue and Green | 1.34 | 0.59 | 0.39 |
| Red and Blue | 0.10 | 1.03 | 0.57 |
| Red and Green | 0.05 | 0.21 | 1.08 |

| | Image-Receiving Element 5 Density | | |
|---|---|---|---|
| Type Exposure | Red Filter | Green Filter | Blue Filter |
| Blue and Green | 1.29 | 0.51 | 0.38 |
| Red and Blue | 0.08 | 0.92 | 0.57 |
| Red and Green | 0.04 | 0.16 | 1.01 |

| | Image-Receiving Element 6 Density | | |
|---|---|---|---|
| Type Exposure | Red Filter | Green Filter | Blue Filter |
| Blue and Green | 1.28 | 0.50 | 0.39 |
| Red and Blue | 0.09 | 0.95 | 0.55 |
| Red and Green | 0.06 | 0.17 | 0.99 |

| | Image-Receiving Element 7 Density | | |
|---|---|---|---|
| Type Exposure | Red Filter | Green Filter | Blue Filter |
| Blue and Green | 1.33 | 0.63 | 0.41 |
| Red and Blue | 0.09 | 0.95 | 0.59 |
| Red and Green | 0.09 | 0.15 | 1.13 |

| | Image-Receiving Element 8 Density | | |
|---|---|---|---|
| Type Exposure | Red Filter | Green Filter | Blue Filter |
| Blue and Green | 1.34 | 0.66 | 0.45 |
| Red and Blue | 0.07 | 0.98 | 0.62 |
| Red and Green | 0.07 | 0.17 | 1.21 |

| | Image-Receiving Element 9 Density | | |
|---|---|---|---|
| Type Exposure | Red Filter | Green Filter | Blue Filter |
| Blue and Green | 1.22 | 0.57 | 0.37 |
| Red and Blue | 0.09 | 0.94 | 0.56 |
| Red and Green | 0.07 | 0.13 | 1.14 |

| | Image-Receiving Element 10 Density | | |
|---|---|---|---|
| Type Exposure | Red Filter | Green Filter | Blue Filter |
| Blue and Green | 1.25 | 0.59 | 0.40 |
| Red and Blue | 0.10 | 0.96 | 0.54 |

-continued

| | | | |
|---|---|---|---|
| Red and Green | 0.08 | 0.16 | 1.09 |

These above tabulated results show improved densities obtained with the image-receiving elements.

What is claimed is:

1. An image-receiving element for use in a color diffusion transfer process, which comprises a support having thereon an image-receiving layer containing a mordanting homopolymer having therein a repeating structural unit represented by the following general formula (I)

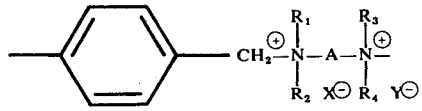

(I)

wherein each of $R_1$, $R_2$, $R_3$ and $R_4$ is an alkyl group, a hydroxyalkyl group or an aralkyl group; each of $R_1$ and $R_3$, and $R_2$ and $R_4$, can combine to form an alkylene group; A is an alkylene group, an arylene group or a group of the formula

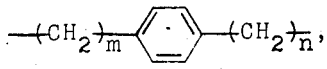

in which *m* and *n* each represents 0 or an integer of 1 to 3, with at least one of *m* and *n* being an integer of at least 1; and $X^{\ominus}$ and $Y^{\ominus}$ each represents a monovalent anion.

2. The element of claim 1, wherein said structural unit of said homopolymer mordant is represented by the formula

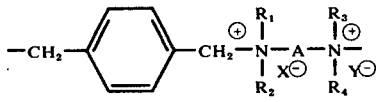

wherein $R_1$, $R_2$, $R_3$, $R_4$, A, $X^{\ominus}$ and $Y^{\ominus}$ are as defined in claim 1.

3. The element of claim 1, wherein $R_1$, $R_2$, $R_3$ and $R_4$ each contains 1 to 10 carbon atoms.

4. The element of claim 1, wherein $X^{\ominus}$ and $Y^{\ominus}$ are halogen ions.

5. The element of claim 4, wherein $X^{\ominus}$ and $Y^{\ominus}$ are chlorine ions.

6. The element of claim 1, wherein said homopolymer has a molecular weight of about 1,000 to 100,000.

7. The element of claim 1, wherein said image-receiving layer includes a water-soluble polymer.

8. The element of claim 7, wherein the proportion of said polymer is 10 to 100% by weight based on the weight of the image-receiving element.

9. The element of claim 7, wherein said water-soluble polymer is polyvinyl alcohol.

10. The element of claim 1, wherein the image-receiving layer has a thickness of about 3 to 10 microns.

11. A process of forming a color image in the color diffusion transfer process comprising developing by spreading an alkaline processing solution in the presence of a silver halide developing agent between an exposed silver halide photosensitive element containing at least one silver halide emulsion layer having a dye image former associated therewith and the image-receiving element of claim 1.

12. The process of claim 11, wherein said structural unit of said homopolymer mordant is represented by the formula

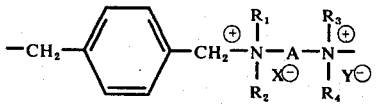

wherein $R_1$, $R_2$, $R_3$, $R_4$, A, $X^{\ominus}$ and $Y^{\ominus}$ are as defined in claim 12.

13. The process of claim 12, wherein $R_1$, $R_2$, $R_3$ and $R_4$ each contains 1 to 10 carbon atoms.

14. The process of claim 12, wherein $X^{\ominus}$ and $Y^{\ominus}$ are halogen ions.

15. The process of claim 14, wherein $X^{\ominus}$ and $Y^{\ominus}$ are chlorine ions.

16. The process of claim 11, wherein said homopolymer has a molecular weight of about 1,000 to 100,000.

17. The process of claim 11, wherein said image-receiving layer includes a water-soluble polymer.

18. The process of claim 17, wherein the proportion of said polymer is 10 to 100% by weight based on the weight of the image-receiving element.

19. The process of claim 17, wherein said water-soluble polymer is polyvinyl alcohol.

20. The process of claim 11, wherein the image-receiving layer has a thickness of about 3 to 10 microns.

21. The process of claim 11, wherein said dye image former is a dye developer.

22. The process of claim 11, wherein said silver halide developing agent is a color developing agent and said dye image former is a non-diffusible compound capable of coupling with an oxidized color developing agent and capable of releasing a soluble and diffusible dye in said alkaline processing solution.

23. The process of claim 22, wherein said non-diffusible compound has the following general formula (1) or (2):

1. (CP-1)-L(Fr)
2. (CP-2)-L(Bl)

wherein Cp-1 represents a coupling-reactive structural moiety in which the coupling site is substituted with an (FR)-L- residue, and at least one non-coupling site contains a hydrophobic group of at least about 8 carbon atoms and is substituted with a group capable of rendering the coupler molecule diffusion resistant, Cp-2 represents a coupling-reactive structural moiety in which the coupling site is substituted with a (B1)-L-residue, with the proviso that when the compound of the general formula (2) is used in conjunction with a developer which does not contain a water-solubilizing group, the CP-2 group has a water-solubilizing group in at least one of the non-coupling sites; (Fr)-L- and (Bl)-L- represent groups capable of being split off by the oxidized developer; Fr represents a dye structural moiety having an absorption in the visible wavelength region and containing at least one water-solubilizing group; and B1 represents a group containing a hydrophobic group with at least about 8 carbon atoms and capable of rendering the coupler molecule diffusion resistant.

24. The process of claim 11, wherein said image-receiving element further contains a neutralizing acidic layer between said image-receiving layer and the support of said image-receiving element.

25. The process of claim 24, wherein said neutralizing acidic layer is a film-forming acidic polymer containing at least one of a carboxyl group, sulfo group or a group capable of being converted to a carboxyl group by hydrolysis.

26. The process of claim 25, wherein the thickness of said neutralizing acidic polymer is about 5 to 30 microns.

27. The process of claim 24, wherein said image-receiving element further contains a spacer layer between said image-receiving layer and said neutralizing acidic layer.

28. The process of claim 27, wherein said spacer layer has a thickness of about 3 to 20 microns.

* * * * *